US009024713B1

(12) United States Patent
Carlson

(10) Patent No.: US 9,024,713 B1
(45) Date of Patent: May 5, 2015

(54) EXTREME DUTY ENCAPSULATED TRANSFORMER COIL WITH CORRUGATED COOLING DUCTS AND METHOD OF MAKING THE SAME

(71) Applicant: Power Distribution Products, Inc., Chilhowie, VA (US)

(72) Inventor: Kurt Carlson, Bluff City, TN (US)

(73) Assignee: Power Distribution Products, Inc., Chillhowie, VA (US)

( * ) Notice: Subject to any disclaimer, the term of this patent is extended or adjusted under 35 U.S.C. 154(b) by 0 days.

(21) Appl. No.: 13/956,638

(22) Filed: Aug. 1, 2013

Related U.S. Application Data

(60) Provisional application No. 61/681,377, filed on Aug. 9, 2012.

(51) Int. Cl.
*H01F 27/08* (2006.01)
*H01F 27/30* (2006.01)

(52) U.S. Cl.
CPC ..... *H01F 27/085* (2013.01)

(58) Field of Classification Search
USPC ..... 336/60, 196, 208, 179, 185, 199, 207
See application file for complete search history.

(56) References Cited

U.S. PATENT DOCUMENTS

| | | | | | |
|---|---|---|---|---|---|
| 1,563,426 | A | * | 12/1925 | Marbury | 361/270 |
| 2,424,973 | A | | 8/1947 | Edmonds | |
| 3,246,271 | A | | 4/1966 | Ford | |
| 3,252,117 | A | * | 5/1966 | Fischer | 336/187 |
| 3,263,196 | A | * | 7/1966 | Reber | 336/96 |
| 3,302,149 | A | | 1/1967 | Forsha | |
| 3,585,276 | A | | 6/1971 | Beckett | |
| 3,710,293 | A | | 1/1973 | Lazor | |
| 3,713,061 | A | | 1/1973 | Weber | |
| 3,748,616 | A | * | 7/1973 | Weber et al. | 336/60 |
| 3,934,332 | A | | 1/1976 | Trunzo | |
| 4,335,367 | A | | 6/1982 | Mitsui | |
| 4,449,111 | A | | 5/1984 | Nakajima | |
| 4,649,640 | A | * | 3/1987 | Ito et al. | 29/605 |
| 5,566,443 | A | | 10/1996 | Allan | |
| 6,160,464 | A | | 12/2000 | Clarke | |
| 8,181,334 | B2 | | 5/2012 | Weber | |
| 2008/0223517 | A1 | | 9/2008 | Kaltenborn | |
| 2009/0212897 | A1 | | 8/2009 | Schaal | |
| 2011/0140821 | A1 | | 6/2011 | Gruettner | |

* cited by examiner

*Primary Examiner* — Mangtin Lian
(74) *Attorney, Agent, or Firm* — Brian S. Steinberger; Phyllis K. Wood; Law Offices of Brian S. Steinberger, P.A.

(57) ABSTRACT

Methods and devices for an extreme duty transformer with wet wound primary and secondary winding encapsulated with a resin and having corrugated insulating material as cooling ducts as a transformer capable of withstanding extreme mechanical stresses in an underground mining environment. The method includes providing a resin impregnated rectangular winding form, forming a secondary winding with alternating layers of magnet wire with a resin impregnated insulating collar above and below the magnet wire and corrugated insulating material extending the full or partial circumference and width of the coil. An insulating layer of corrugated material and resin impregnated insulation is wound to separate the primary from the secondary windings. The primary winding is wound with alternating magnet wire layers and resin impregnated insulation layers and a resin impregnated outer layer covers the circumference of the coil to produce an oval mechanically robust construction preventing winding displacement and sealing out environmental contaminants.

21 Claims, 10 Drawing Sheets

EXTREME DUTY ENCAPSULATED TRANSFORMER COIL WITH CORRUGATED COOLING DUCTS AND METHOD OF MAKING THE SAME

This application claims the benefit of priority to U.S. Provisional Application No. 61/681,377 filed on Aug. 9, 2012.

FIELD OF THE INVENTION

This invention relates to transformers and, in particular, to methods, systems and devices for a transformer with wet wound transformer coils encapsulated with a resin material and having corrugated insulating material as cooling ducts to produce a transformer that is capable of withstanding extreme mechanical stresses in an underground mining environment.

BACKGROUND AND PRIOR ART

The current technology that is used in underground mining transformer coil design is primarily conventional open wound and epoxy vacuum cast. Cooling transformers during operation has been a long standing problem and a variety of solutions have been used including use of coolant fluids, cooling tanks surrounding the transformer; transformers submerged in transformer oil; and the use of spacers in dry-type transformers that separate sections or layers of the transformer. A primary difference between the type of transformer and thus transformer cooling used, is the environment in which the transformer is used.

The typical operating environment of an underground mining transformer is such that it subjects the transformer to environmental contaminants such as moisture and coal dust which reduces the dielectric performance of the transformer over time. The expected load duty cycle is also very severe in underground mining environment subjecting the mine duty transformer to extreme swings in thermal loading as well as frequent short circuits. Another environmental challenge in the underground mining environment is real estate, resulting in reduced spacing between adjacent transformer coils which increases the environmental temperature surrounding the transformers.

The current industry accepted transformer construction is dry type (not oil filled or gas filled) non cast open wound construction that uses duct sticks to create air cooling ducts. This construction has always been problematic for the expected operating environment because it does not adequately prevent coil distortion when subjected to the mechanical stresses of a short circuit.

During a short circuit event, the magnetic forces tend to cause the primary winding to repel the secondary winding resulting in coil distortion. The coil tends to change shape such that the primary winding is forced outward causing the overall outside diameter of the coil to increase in physical size. This distortion of adjacent transformer coils combined with the reduced spacing between adjacent transformer coils can cause phase-to-phase failure. This phase-to-phase failure is extremely undesirable since it tends to decrease the electrical clearance between adjacent phases and can result in a phase-to-phase fault. The phase-to-phase failure also changes the impedance of the transformer. If the forces are large enough, the windings can also be forced out of the ends of the coils toward the core and clamping structure resulting in a phase to ground failure.

Another issue that frequently results from coil distortion is that the duct sticks used to create air ventilation passages will often loosen and fall out of the bottom of the coil reducing the air flow and efficiency of the cooling ducts. Thus, cooling ducts created using ducts sticks fail to solve the problems associated with reduced transformer spacing and harsh operating environments.

What is needed in this environment is a transformer with environmentally sealed transformer coils that incorporates rigid cooling ducts that are capable of withstanding extreme mechanical stresses.

SUMMARY OF THE INVENTION

A primary objective of the present invention is to provide methods, systems and devices for a transformer with environmentally sealed transformer coils that are capable of withstanding extreme mechanical stresses in the underground mining environment.

A secondary objective of the present invention is to provide methods, systems and devices for a transformer with wet wound transformer coils encapsulated with a resin and having corrugated insulating material as cooling ducts to produce a transformer for extreme duty.

A third objective of the present invention is to provide a methods for producing a wet wound transformer coil that results in a mechanically robust construction preventing winding displacement and sealing out environmental contaminants.

A fourth objective of the present invention is to provide methods for producing a wet wound transformer coil that utilizes corrugated insulating material to form cooling ducts in place of the conventionally used duct stick method.

A first embodiment provides an extreme duty transformer coil that includes a winding form, a secondary winding layer formed by winding alternating layers wire wound around the winding form a distance from a top and a bottom of the winding form with an insulating collar between the top of the winding form and the layer of secondary wire and the bottom of the winding form and the layer of secondary wire and a corrugated ducting layer extending the full circumference and width of the coil between each next layer of secondary magnet wire to form cooling ducts, then a barrier insulating layer is wound to separate the secondary winding from a primary winding. The primary winding includes primary wire layers wound around the barrier insulating layer and insulation layer extending the full circumference and width of the coil between each next layer of primary wire, then a resin impregnated outer layer covering the circumference of the transformer coil to produce an oval mechanically robust construction preventing winding displacement and sealing out environmental contaminants. The extreme duty transformer coil is rotated during the curing cycle to prevent sagging of the resin impregnated layers and runoff of the resin.

The winding form can include a resin impregnated rectangular winding form and or a layer of resin impregnated fiberglass mesh wet wound around the outer surface of the winding form, and or a layer of wet wound resin impregnated insulation wound around the outer surface of the winding form.

The barrier insulating layer separating the secondary winding from a primary winding can include one or more layers of corrugated insulating duct material wound around the circumference and width of the coil to form cooling ducts and can include a deformable resin impregnated insulation layer wet wound around a full or partial circumference and width of the coil to prevent displacement of the layers of corrugated insulating duct material. The resin impregnated deformable layer can be a resin saturated felt.

The corrugated ducting layer can be made from an insulating material selected from a range of approximately 0.0001 volts per mil to approximately 100,000 volts per mil to meet operational requirements and eliminate the need for additional layers of insulation between windings and have a thickness within a range from approximately 0.000001 of an inch to approximately 10 inches in thickness.

The barrier insulation layer can include a fiber resin impregnated insulating material such as a resin impregnated adaptable felt material and or a woven resin impregnated fiberglass mesh.

The resin impregnated outer layer can include a resin impregnated fiberglass rope wound as an outer layer around the circumference of the transformer coil to prevent outward distortion of the coil and a resin saturated felt layer and or a layer of woven resin impregnated fiberglass mesh.

A second embodiment provides a method for producing an extreme duty transformer coil that includes providing a winding form, forming a secondary winding by alternately winding a layer of secondary magnet wire layer around the winding form a distance from the top and bottom of the winding form with a wet wound insulating collar between the top of the winding form and the layer of magnet wire and the bottom of the winding form and the layer of magnet wire and winding a secondary corrugated duct insulating layer in a single sheet to form cooling ducts between adjacent layers of secondary magnet wire, the corrugated duct insulating layer extending the full circumference and width of the coil; winding a barrier layer to separate the secondary winding from a primary winding by winding a barrier corrugated duct insulating layer extending the full circumference and width of the coil over the secondary winding, forming the primary winding by alternately winding a primary magnet wire layer a distance from the top and bottom of the winding form between the top and the bottom of the winding form and the layer of magnet wire and winding one or more of a primary corrugated duct insulating layer and a primary insulation layer between adjacent primary magnet wire layers, and winding an outer layer covering the circumference and width of the primary winding for mechanical strength to prevent winding displacement and to seal out environmental contaminants.

The rectangular winding form step can include wet winding a resin impregnated mesh around the winding form to strengthen the winding form to prevent distortion of the coil and or resin impregnating the rectangular winding form.

The secondary winding step includes wet winding a top and a bottom collar to fill an area between the top of the winding form and the secondary magnet wire layer and the bottom of the winding form and the secondary magnet wire layer to prevent exposure of the secondary magnet wire layer. Winding a secondary corrugated duct insulating layer can include the step of winding a secondary corrugated duct layer around a circumference and width of the secondary magnetic wire layer and applying a wet wound layer of insulating material around a circumference and width of the secondary corrugated duct layer.

The barrier corrugated duct insulating layer step can include winding one or more barrier corrugated duct layers around a circumference and width of the secondary magnetic wire layer and applying one or more wet wound layers of barrier insulating material around a circumference and width of the barrier corrugated duct layer. The wet winding barrier insulating material step can be a layer of resin impregnated insulation material or a layer of resin saturated felt material.

The step of winding a resin impregnated outer layer can include covering the outer circumference and width of the coil with a resin impregnated mesh layer in a single sheet and or winding a resin impregnated fiberglass rope as an outer layer around the circumference of the coil covering the resin impregnated mesh to prevent outward distortion of the coil, and or applying a wet fiber-resin material to the resin impregnated fiberglass rope layer to fill in the gaps.

The method further includes rotating the extreme duty transformer coil while curing to prevent sagging of the resin impregnated layers and runoff of the resin from the resin impregnated insulation and resin impregnated insulating felt.

Further objects and advantages of this invention will be apparent from the following detailed description of preferred embodiments which are illustrated schematically in the accompanying drawings.

DESCRIPTION OF THE PREFERRED EMBODIMENTS

Figure 1:
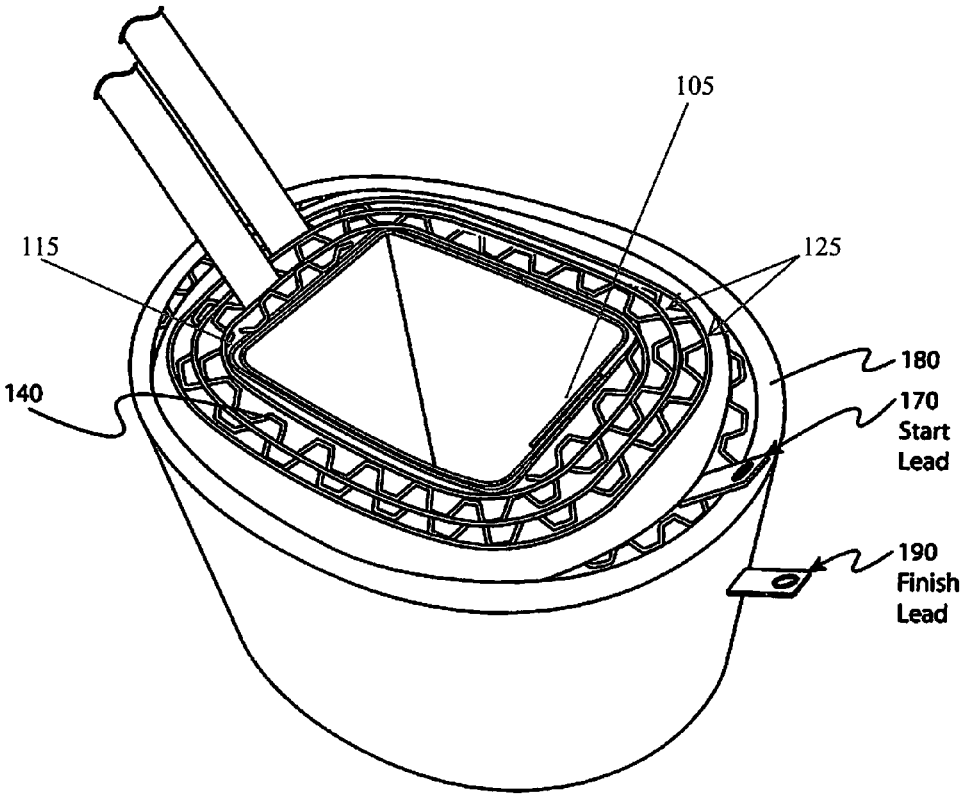
FIG. 1 is a perspective view showing the corrugated ducting and fiberglass resin encapsulating windings according to the present invention.

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

The following is a list of reference numerals used throughout the description to identify elements shown in the drawings:

100 transformer
105 winding frame
110 winding form
115 impregnated mesh layer
120 insulating layer
125 resin barrier insulation layer
130 winging layer
140 corrugated ducting layer
150 collar

160 saturated felt layer
170 bus bar start lead
180 impregnated rope layer
190 bus bar finish lead
200 secondary winding
300 barrier
400 primary winding This invention is intended to address the previously outlined problems specific to the underground mining environment. These problems are solved by producing a wet wound transformer coil that incorporates rigid cooling ducts that result in a mechanically robust construction preventing winding displacement and sealing out environmental contaminants. This is achieved by applying resin in conjunction with various fiberglass reinforcing materials throughout the winding process to eliminate voids within the wound coil, thus preventing corona development. The outside layer of the coil is specifically reinforced with resin impregnated fiberglass mesh and resin impregnated fiberglass rope applied to the circumference of the coil to prevent outward coil distortion.

The dielectric performance of the coil is improved as a result of the glass-resin which has excellent insulation characteristics. Another characteristic of this coil design is that it utilizes corrugated insulating material to insulate windings and form rigid cooling ducts in place of the duct sticks used in the prior art transformers.

The corrugated ducting layer is made from an insulating material selected to meet operational requirements can range from approximately 0.0001 volts per mil to approximately 100,000 volts per mil., thus eliminating the need for additional layers of insulation between windings. The thickness of the corrugated ducting material can range from approximately 0.000001 of an inch to approximately 10 inches thick. The corrugated ducting layer is applied as a continuously fed sheet that extends the full circumference and width of the coil in a single sheet to prevent the corrugated ducting material from becoming displaced.

FIG. 1 is a perspective view showing the corrugated ducting and resin encapsulating windings according to the present invention. As shown, the transformer is oval shaped, wound around a rectangular winding form for use with a rectangular cross section core. This aspect of the design provides the superior short circuit strength of a round coil with the reduced overall height profile of rectangular core construction needed to meet the low profile height requirement of the underground mining environment.

The method of the present invention uses a winding technique where fiberglass resin is applied in conjunction with various reinforcing materials throughout the winding process to produce a transformer coil with a mechanically robust construction that prevents winding displacement, eliminates voids which prevents corona development and seals out environmental contaminants. A variety of different resin reinforcing materials can be used for encapsulating the coil according to the present invention. For example, the resin materials used in construction of the extreme duty transformer can include one or more of a fiber resin impregnated insulating material, a resin impregnated adaptable insulation material such as a felt and a woven resin impregnated fiberglass mesh, or any combination thereof.

Figure 2:
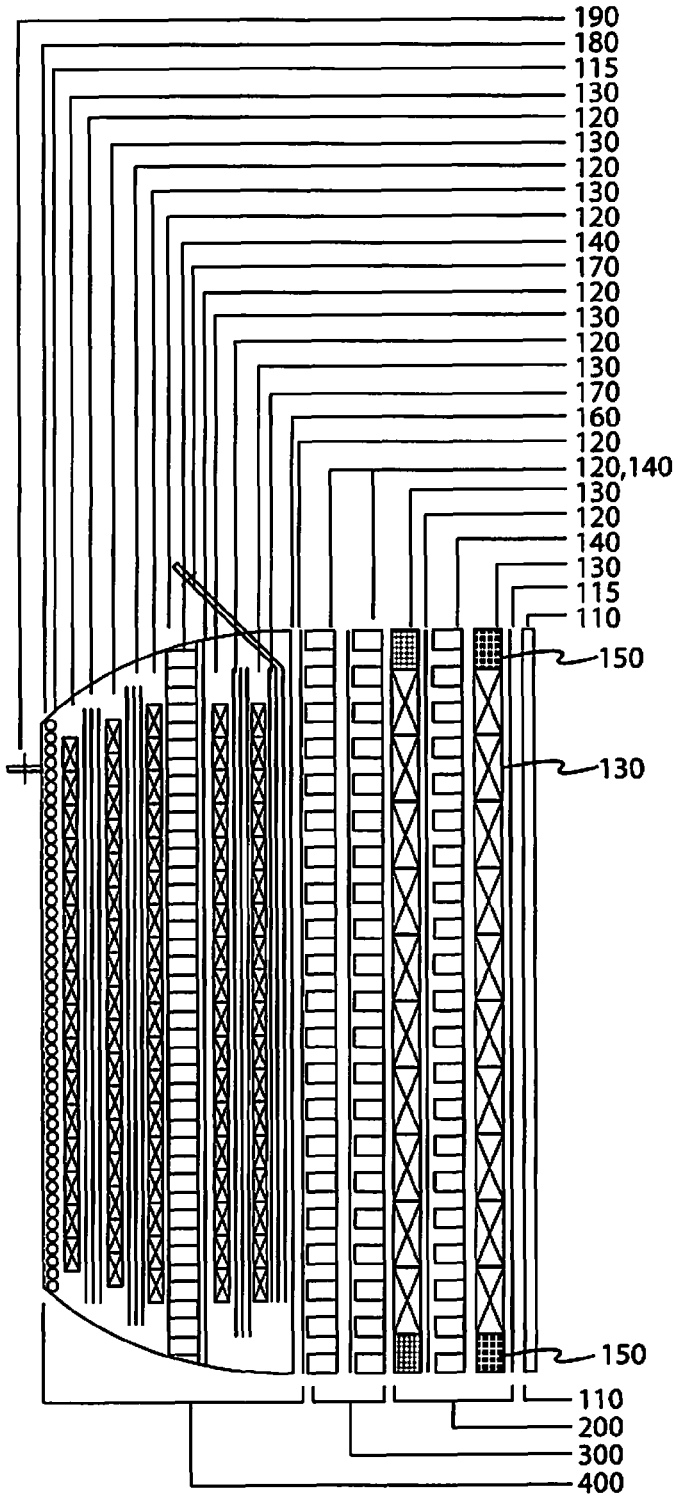
FIG. 2 is a cutaway side view of an example of a transformer configuration according to the present invention.
Figure 3:
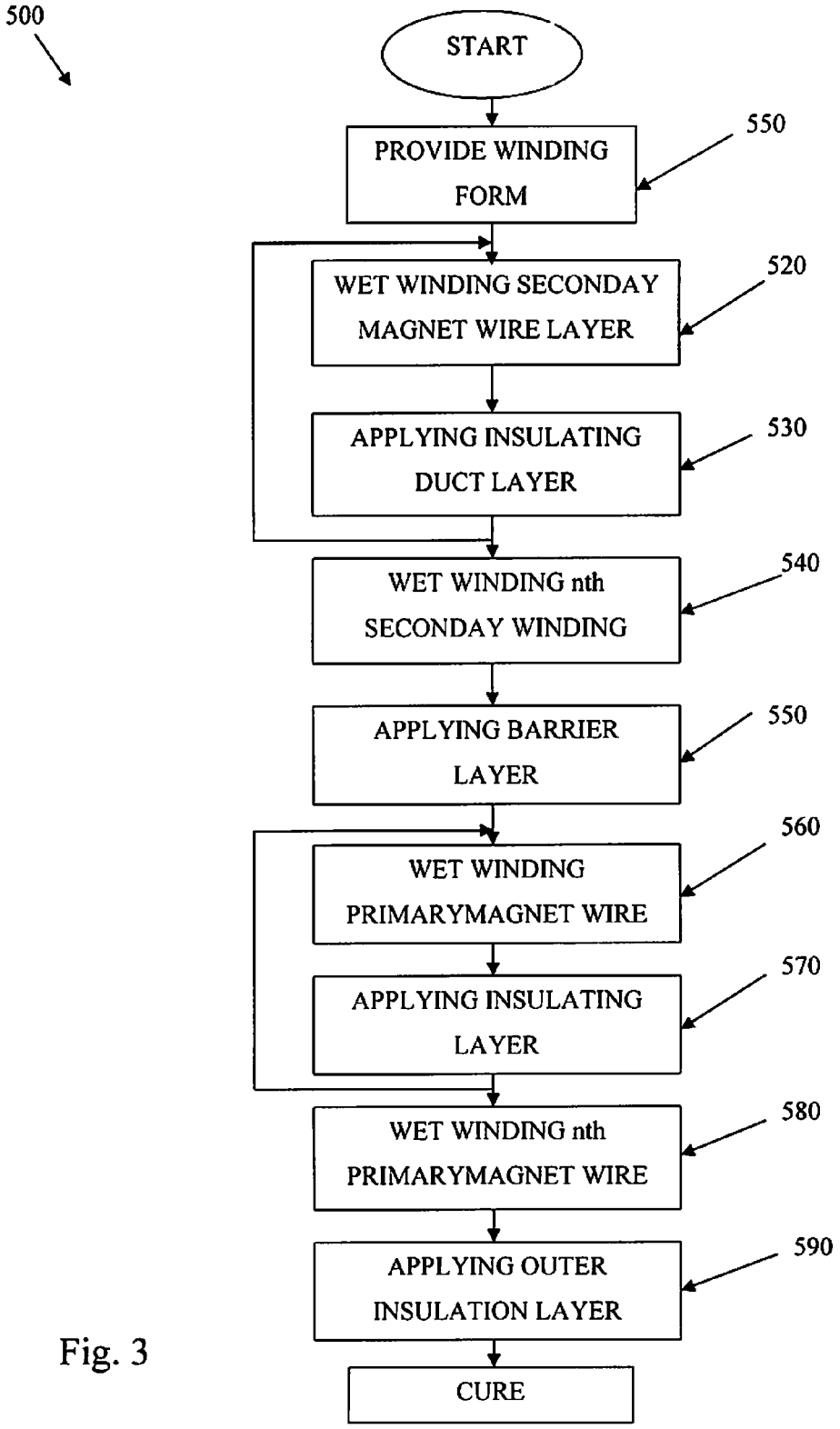
FIG. 3 is a flow diagram showing the steps for constructing the wet-wound transformer shown in FIG. 1.
Figure 4:
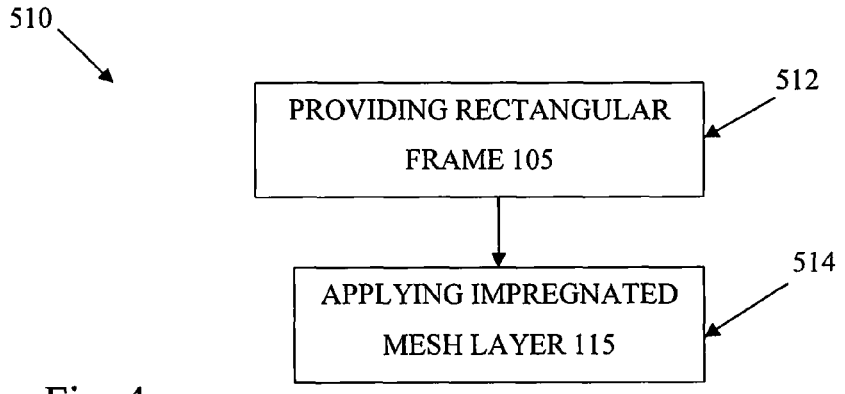
FIG. 4 is a flow diagram of the steps for providing the winding form step shown in FIG. 3.

An example of the construction of the extreme duty transformer is shown in FIG. 2 which is a cutaway side view of an example of a transformer configuration according to an embodiment of the present invention. FIG. 3 is a flow diagram showing the steps for constructing the wet-wound transformer shown in FIG. 1. First, a winding form provided in step 510 can be impregnated with resin for winding the transformer coil secondary windings as shown in FIG. 3. In the example shown in FIG. 1, the winding form can include an overlapping winding frame 105 reinforced in step 514 with a layer of woven resin impregnated fiberglass mesh 115 for strength as shown in FIG. 4.

Figure 5:
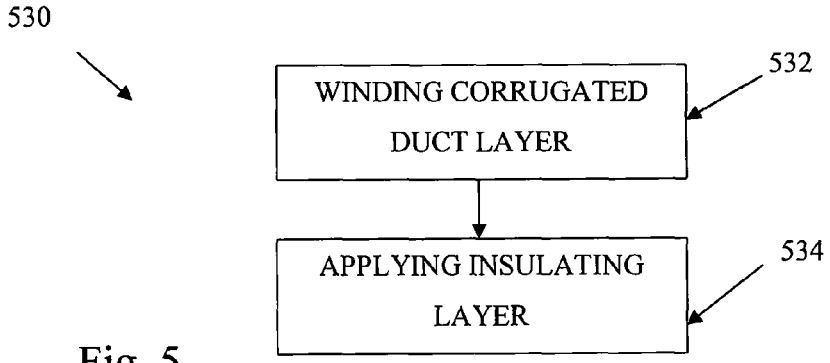
FIG. 5 is a flow diagram of the steps for the insulating layer step shown in FIG. 3.
Figure 6:
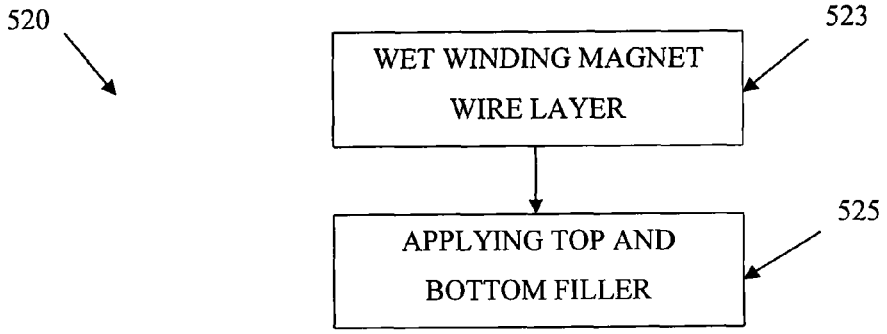
FIG. 6 is a flow diagram of the steps for winding secondary winding step shown in FIG. 3.

FIG. 6 is a flow diagram of the steps for the secondary winding step 520 and FIG. 5 is a flow diagram of the steps for applying the insulating layer. The actual winding wires are wound around the reinforced winding form in step 523 spaced a distance from the top and bottom of the winding form. In step 525 an insulating collar 150 is applied to fill the area between the winding wire 130 and the top of the winding form 110 and between the winding wire 130 and the bottom of the winding form 110. The insulating collar 150 can be wet wound to seal the coil from external contaminants and to prevent exposure of the low voltage secondary winding which would be an electrical hazard.

FIG. 5 is a flow diagram of the steps for applying the insulating layer step 530 between windings of the secondary coil. As shown, in step 532 a corrugated ducting layer is applied around the circumference and width of the previously wound winding and upper and lower collars as shown in FIGS. 1 and 2. An insulating layer can be applied in step 534 over the corrugated duct layer. Or, alternatively, an insulating layer can be wound over the winding layer prior to applying the corrugated ducting layer.

Figure 10:
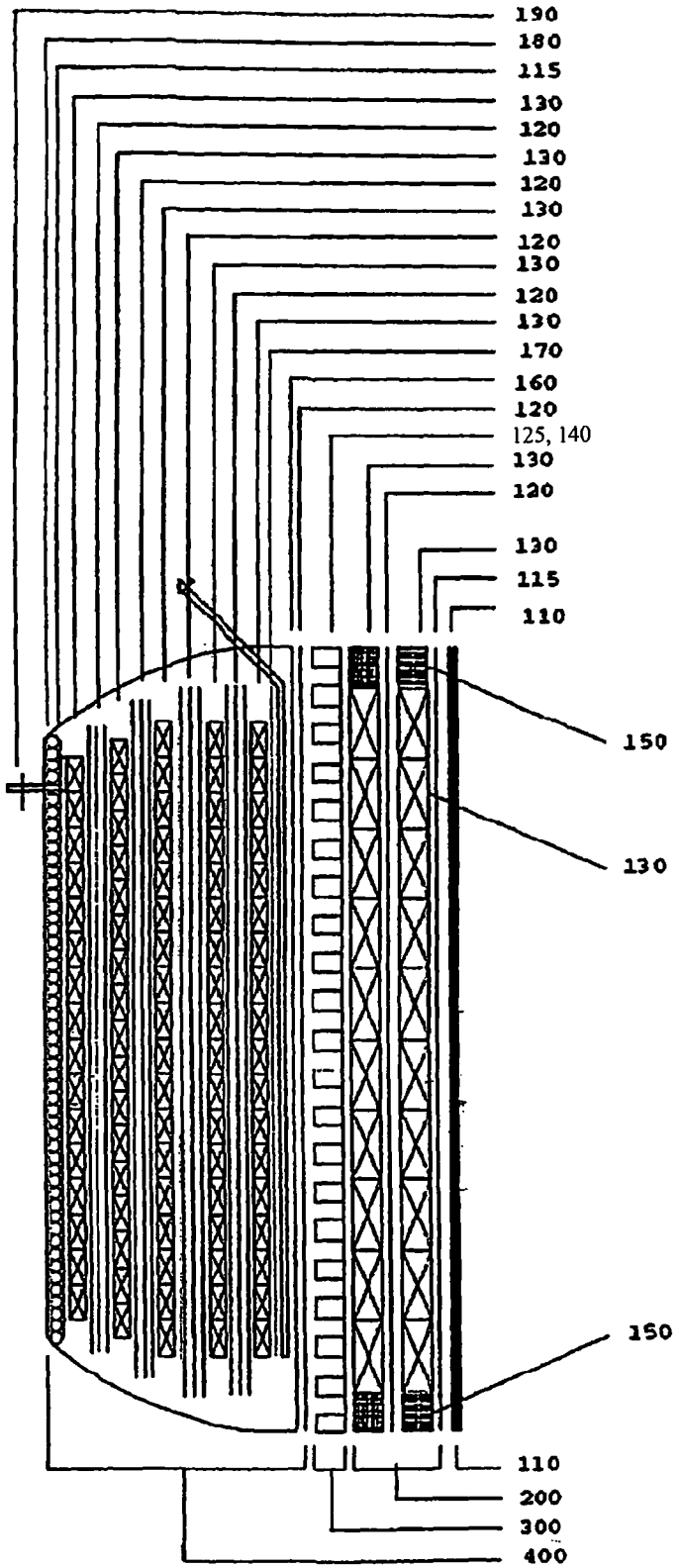
FIG. 10 is a cutaway view of another example of a transformer configuration according to the present invention.

Each coil is designed to meet customer specifications. One skilled in the art should realize that the particularities in the number of winding in each of the primary and secondary windings of the transformer are dependent on the voltage and current requirement of the extreme duty transformer. Likewise, the number of insulation and corrugated ducting layers applied and the thickness of the insulation layers and corrugated ducting layer can be varied according to voltage and current requirements. FIG. 1 and FIG. 10 show cutaway views of two different transformer configurations as examples.

Figure 7:
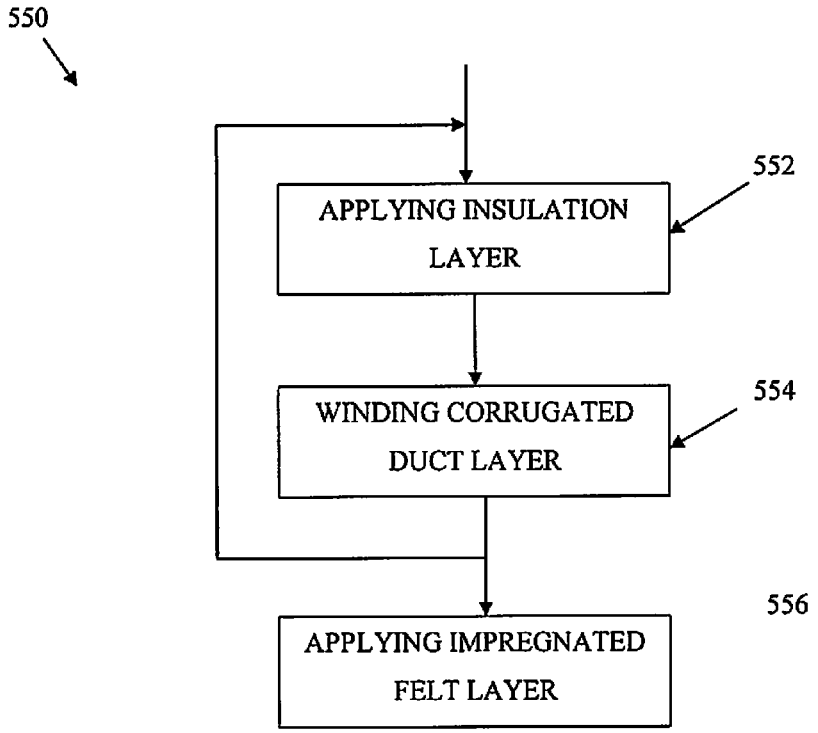
FIG. 7 is a flow diagram of the steps for the barrier application step shown in FIG. 3.

FIG. 7 is a flow diagram of the steps for the barrier application step 550 shown in FIG. 3. After the final layer of wire is wound for the secondary winding, an insulating layer and corrugated duct material is applied as a barrier layer 300 between the primary windings 400 and secondary windings 200 in steps 552 and 554. Depending on the voltage and current requirements for the coil under construction, two or more layers are applied before a resin saturated felt 160 layer is applied in step 556.

The example shown in FIG. 2 includes two layers of resin impregnated wet wound insulating material and corrugated insulation layers between the primary and secondary windings. Insulating the secondary from the primary with resin impregnated insulation in combination with the corrugated insulating material prevents coil distortion that results during a short circuit condition which causes the primary winding to repel the secondary winding.

Figure 11:
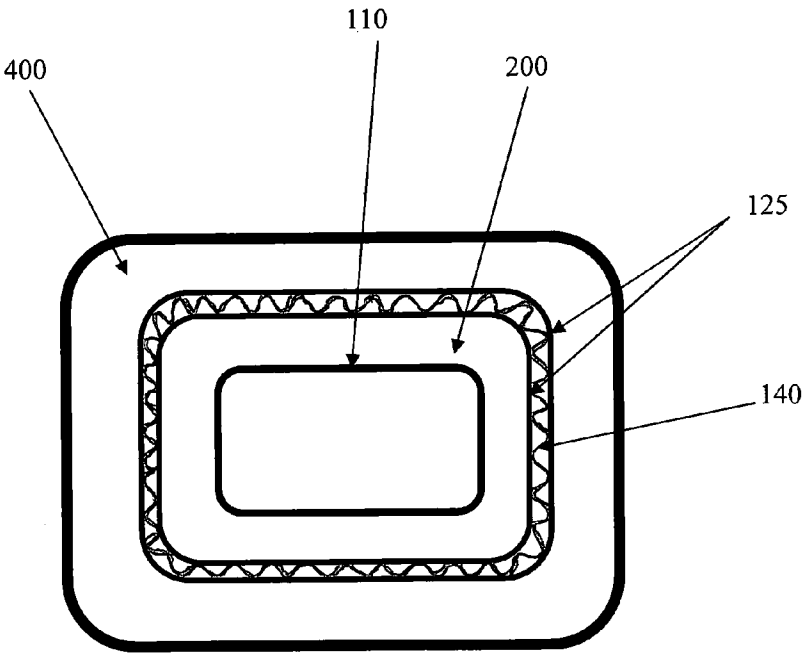
FIG. 11 is a top view showing the winding form, the secondary winding, the barrier layer with corrugated ducting material sandwiched between resin barrier insulation layers, and the primary layer 400.
Figure 12:
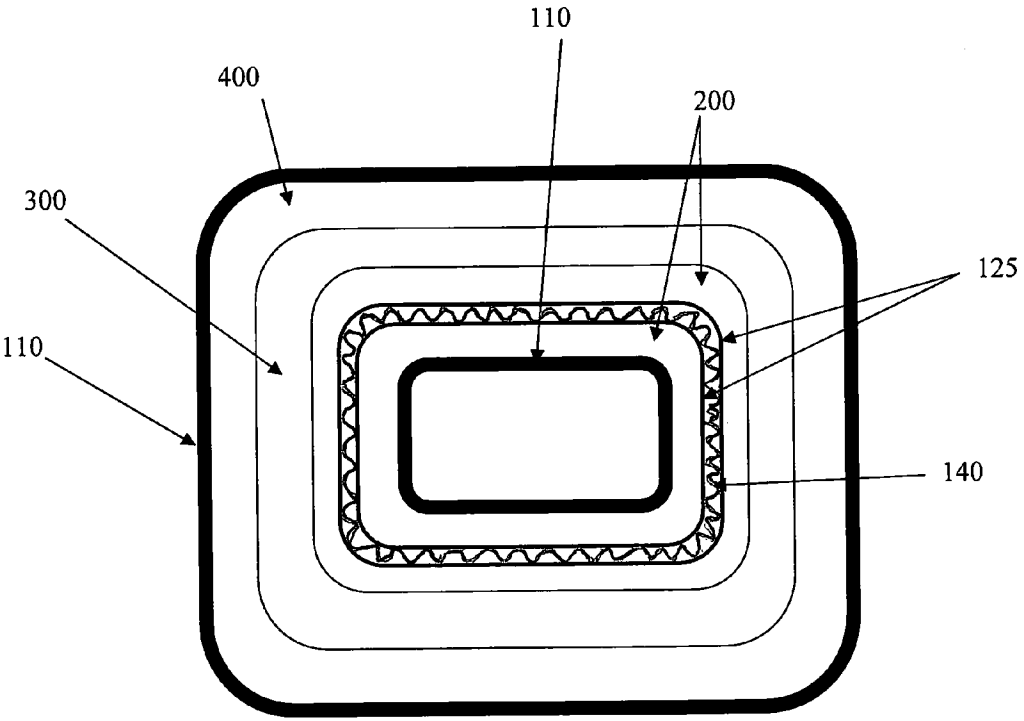
FIG. 12 is a top view showing the winding form, secondary winding with an insulating layer of corrugated ducting layer sandwiched between resin barrier insulation layers between a first and second secondary winding.

FIG. 11 shows an example of a transformer showing the winding form 110, the secondary winding 200, the barrier layer 300 with corrugated ducting material 140 sandwiched between resin barrier insulation layers 125, and the primary winding layer 400. Another example is shown in FIG. 12, shows a top view showing the winding form 110, secondary winding 200 with an insulating layer of corrugated ducting material 140 sandwiched between resin barrier insulation layers 125 between two secondary winding layers 130.

One skilled in the art should realize that the particularities in the resin and corrugated insulation material should not be construed as limitation of the preferred embodiment. Various configurations and corresponding material compositions may be chosen and optimized for a particular application to achieve a desired performance and other materials, configurations and spacing can be substituted.

Figure 8:
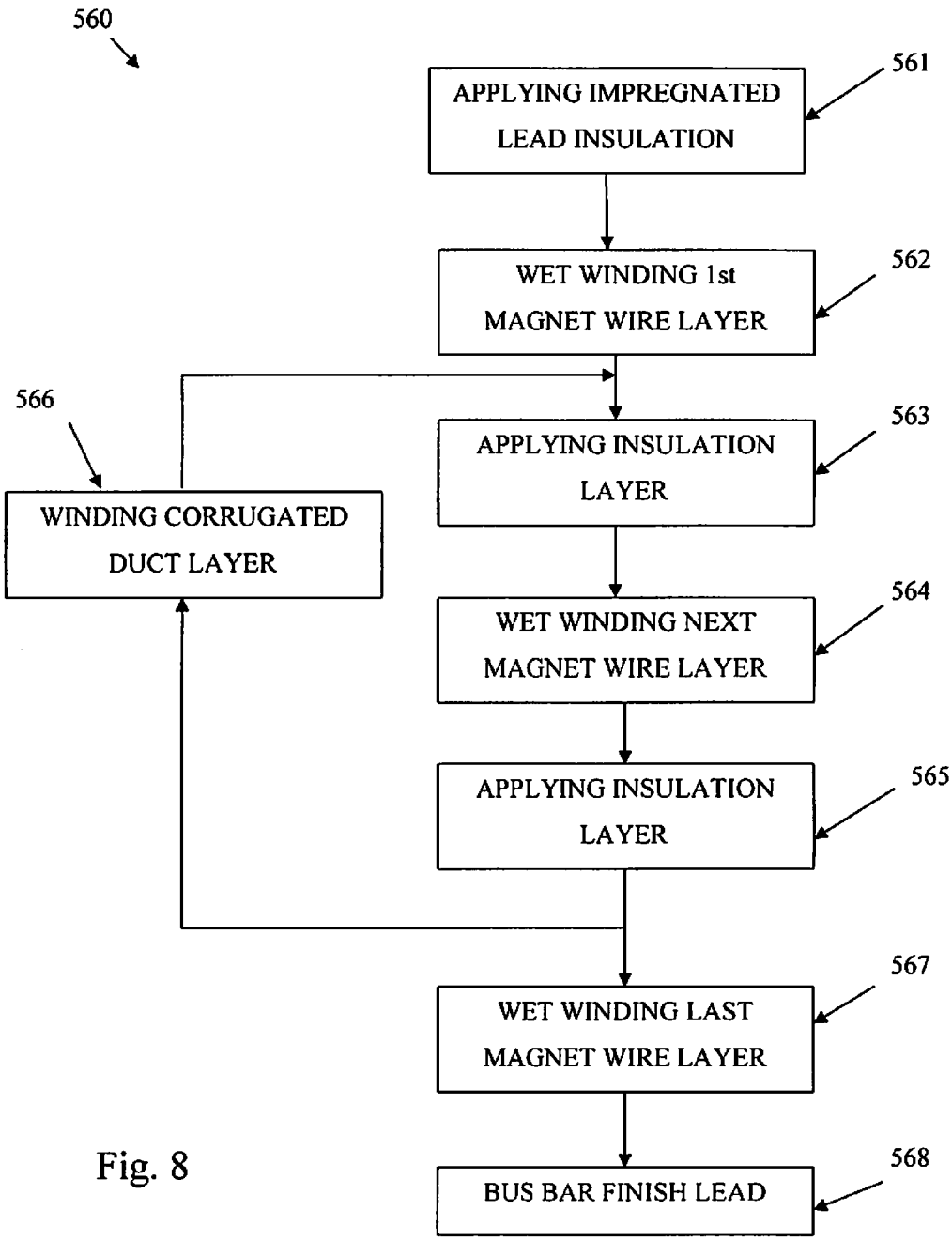
FIG. 8 is a flow diagram of the steps for winding the secondary winding step.

FIG. 8 is a flow diagram of the steps for winding the primary winding step. After the secondary winding form is set, the first layer of the primary winding is wound on the winding form in step 562 with the insulating collar above and below the winding wires as described for the secondary winding. Before the second layer of winding wires 130 is wound in step 564, a corrugated insulating layer 140 can be wound covering both the insulating collars 150 and the first layer of winding wires 130 as shown in FIG. 2. This low voltage side of the transformer has corrugated insulation to air cool the windings while the wet wound top and bottom collar insulates the windings from the external environment. The corrugated insulation layer extends the full circumference and width of the coil in a single sheet making it impossible for this ducting material to become displaced. The material composition of the corrugated insulation is selected based on the dielectric strength of the material and transformer primary and secondary dielectric requirements.

A next layer of winding wires and top and bottom collar are wound in step 564 with the corrugated duct layer and insulation layer separating the first winding layer from the second winding layer. When required by customer specifications, additional layers of insulation, corrugated ducting and winding wires are wound in steps 565 and 567. As shown in FIG. 1, the secondary winding begins and ends with a start lead 170 and finish lead 160 extending out of the transformer coil winding as shown in FIG. 2.

Referring back to FIG. 2, the configuration of the primary winding 400 differs from the secondary winding 200. Each next winding is separated from the previous winding with a layer of wet wound resin saturated felt in step 563. The saturated felt is wet wound between the wire layers to fill the gaps between the wires and between the layers of wire windings. Filling the gaps eliminates the undesirable corona discharge between the adjacent wires and winding layers. Still referring to FIG. 2, following the layers of resin impregnated insulation and corrugated ducting material, a layer of resin saturated felt is wet wound around the insulation layer. The first layer of magnet wire is wound over the wet wound felt with a resin impregnated lead insulation and uninsulated lead extending a distance out of the transformer.

Alternating layers of magnet wire and wet wound impregnated insulation are wound around the coil in step 562, 563, 564 and 565. After one or more alternating layers of primary wire and wet wound saturated felt, a layer of corrugated ducting material is wound in step 566 for cooling followed by another layer of wet wound resin impregnated insulation in step 563. According to design specification to meet customer requirements, additional alternating layers of magnet wire and resin impregnated insulation layers and saturated felt are wound.

Figure 9:
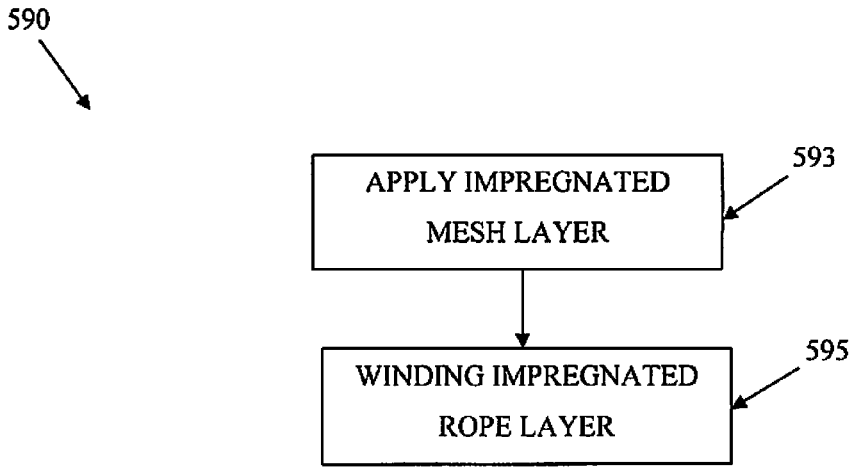
FIG. 9 is a flow diagram of the steps for outer insulation layer application step shown in FIG. 3.

The last magnet wire layer is wound in step 567 with the bus bar finish lead 160 protruding from the side of the coil. FIG. 9 is a flow diagram of the steps for the outer insulation layer application step shown in FIG. 3. Two outer layers 115 and 180 are wound around the final layer of magnet wire 130. First a layer of resin impregnated mesh applied in step 593 covers the last layer of magnet wire then a resin impregnated fiberglass rope 180 is wound around the coil in step 595 covering the fiberglass mesh 115.

The outer layer of the coil is specifically reinforced with resin impregnated fiberglass rope, ranging from 0.0001" diameter to 10" diameter, applied to the circumference to prevent outward coil distortion. The mesh 115 resembles a basket weave and is applied for strength. The combination of the resin impregnated mesh 115 and the resin impregnated fiberglass rope 180 are applied as an outer layer to prevent distortion of the transformer that would cause the outside diameter of the coil to increase in physical size. Thus reducing or eliminating the decrease of the electrical clearance between adjacent phases.

The last step is curing the wet wound transformer while rotating the coil to prevent sagging of the layers and runoff of the resin from the resin impregnated wet wound layers. The transformer of the present invention has environmentally sealed transformer coils that are capable of withstanding extreme mechanical stresses when operated in extreme environments.

An important characteristic of the coil design of the present invention is that it is oval shaped, wound around a rectangular winding form for use with a rectangular core cross section. This aspect of the design provides the superior short circuit strength of a round coil with the reduced overall height profile of rectangular core construction needed to meet the low profile height requirement of the underground mining environment.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. An extreme duty dry type transformer comprising:

a closed winding form;

a secondary winding formed by winding alternating layers consisting essentially of:

a layer of secondary wire-wound around the winding form a distance from a top and a bottom of the winding form with an insulating collar disposed between the top of the winding form and the layer of secondary wire and the bottom of the winding form and the layer of secondary wire; and a secondary corrugated insulating layer with an undulating configuration open at an upper and a lower end extending the full circumference and width of the coil between each next layer of secondary wire to form air cooling ducts, the secondary corrugated insulating layer sandwiched between a first and second resin barrier insulation layer;

a barrier insulating layer separating the secondary winding from a primary winding;

the primary winding including:

a layer of primary wire wound around the barrier insulating layer; and a primary insulation layer of wet wound resin saturated insulating material extending the full circumference and width of the coil between each next layer of primary wire; and a resin impregnated outer layer wet wound around the circumference of the transformer coil to produce an oval mechanically robust construction preventing winding displacement and sealing out environmental contaminants, the extreme duty transformer coil is rotated during the curing cycle to prevent sagging of the resin impregnated layers and runoff of the resin to form the extreme duty dry type transformer.

2. The transformer coil of claim 1 wherein the closed winding form comprises:

a resin impregnated rectangular winding form with overlapping ends.

3. The transformer coil of claim 2 wherein the closed winding form further comprises:

a layer of resin impregnated fiberglass mesh wet wound around the outer surface of the winding form.

4. The transformer coil of claim 1 wherein the barrier insulating layer separating the secondary winding from a primary winding comprises:

one or more layers of corrugated insulating duct material with the undulating configuration open at the upper and the lower end wound around the circumference and width of the coil to form air cooling ducts.

5. The transformer coil of claim 1 wherein the barrier insulating layer separating the secondary winding from a primary winding further comprises:

a resin impregnated insulation layer wet wound around a full or partial circumference and width of the coil to prevent displacement of the one or more layers of corrugated insulating duct material.

6. The transformer coil of claim 1 wherein the resin impregnated layer comprises:

a resin saturated felt.

7. The transformer coil of claim 1 wherein the corrugated ducting layer is made from an insulating material selected from a range of approximately 0.0001 volts per mil to approximately 100,000 volts per mil to meet operational requirements and eliminate the need for additional layers of insulation between windings.

8. The transformer coil of claim 1 wherein the corrugated ducting layer has a thickness within a range from approximately 0.000001 of an inch to approximately 10 inches in thickness.

9. The transformer coil of claim 1 wherein the barrier insulation layer comprises:

a fiber resin impregnated insulating material.

10. The transformer coil of claim 1 wherein the barrier insulation layer comprises:

a resin impregnated adaptable felt material.

11. The transformer coil of claim 1 wherein the barrier insulation layer includes:

a layer of corrugated insulating duct material with the undulating configuration open at the upper and the lower end wound around the circumference and width of the coil to form air cooling ducts; and a first and second resin barrier sandwiching the layer of corrugated insulating duct material.

12. The transformer of claim 1 wherein the resin impregnated outer layer further comprises:

a wet wound layer of resin saturated felt.

13. The transformer of claim 1 wherein the resin impregnated outer layer includes:

a layer of woven resin impregnated fiberglass mesh wet wound around the circumference and width of the transformer coil.

14. The transformer coil of claim 13, wherein the resin impregnated outer layer further comprises:

a resin impregnated fiberglass rope wet wound around the layer of woven resin impregnated fiberglass mesh as an outer layer around the circumference of the transformer coil to prevent outward distortion of the coil.

15. An extreme duty dry type transformer comprising:

a closed winding frame;

a secondary winding formed by winding two or more secondary wire layers around the winding frame a distance from a top and a bottom of the winding frame with a secondary insulating layer between adjacent secondary winding layers and an insulating collar next to the axial end of each secondary layer;

a barrier insulating layer wound around the secondary winding consisting of one or more corrugated insulating layers sandwiched between first and second resin barriers extending the full circumference and width of the coil to form corrugated insulating layer air ducts;

a primary winding formed by winding two or more primary wire layers around the barrier insulating layer with a wet wound primary insulating layer between adjacent primary winding layers; and a resin impregnated outer layer consisting of a resin impregnated mesh layer wound around the primary winding and a impregnated rope layer wound as an outer layer around the circumference of the transformer coil covering the circumference of the transformer coil to produce an oval mechanically robust construction preventing winding displacement and sealing out environmental contaminants, the extreme duty transformer coil is rotated during the curing cycle to prevent sagging of the resin impregnated layers and runoff of the resin.

16. The extreme duty dry type transformer of claim 15 further comprising:

a secondary corrugated insulating layer adjacent to the secondary insulating layer extending the full circumference and width of the coil; and first and second secondary resin barrier insulating layers to sandwich the secondary corrugated insulating layer to form air cooling ducts in the secondary winding.

17. The extreme duty dry type transformer of claim 15 further comprising:

a primary corrugated insulating layer adjacent to the primary insulating layer extending the full circumference and width of the coil; and a second primary resin barrier insulating layer to sandwich the primary corrugated insulating layer to form air cooling ducts in the primary winding.

18. The extreme duty dry type transformer of claim 16 further comprising:

a primary corrugated insulating layer adjacent to the primary insulating layer extending the full circumference and width of the coil; and first and second resin barrier insulating layers to sandwich the primary corrugated insulating layer to form air cooling ducts in the primary winding.

19. The extreme duty dry type transformer of claim 15, wherein the primary insulating material is a layer of wet wound resin saturated felt.

20. The extreme duty dry type transformer of claim 15, wherein the a primary winding is wet wound by winding two or more primary wire layers around the winding frame with a secondary insulating layer wet wound between adjacent secondary winding layers.

21. The extreme duty dry type transformer of claim 15, wherein the two or more primary layers are would a distance from the top and the bottom of the winding frame with an insulating collar disposed next to the axial end of each primary wire layer.

* * * * *